US005417335A

United States Patent [19]

White

[11] Patent Number: 5,417,335

[45] Date of Patent: May 23, 1995

[54] APPARATUS AND METHODS FOR SUSPENDING A PAIR OF SKIS OR THE LIKE

[76] Inventor: Steven M. White, 1123 Channing Way, Berkeley, Calif. 94702

[21] Appl. No.: 173,623

[22] Filed: Dec. 23, 1993

[51] Int. Cl.[6] ..... A47F 7/00

[52] U.S. Cl. ..... 211/70.5; 211/89; 248/316.3; D6/552

[58] Field of Search ..... 211/70.5, 87, 89; 248/316.2, 316.3, 316.5; D6/552

[56] References Cited

U.S. PATENT DOCUMENTS 2,956,812 10/1960 Lundquist ..... 211/70.5 X
3,685,667 8/1972 Bell .
3,826,378 7/1974 Novak .
4,222,490 9/1980 Wood, Jr. .
4,234,113 11/1980 Nalvarian .
4,319,686 3/1982 Avocat .
4,688,685 8/1987 Brace .
4,763,797 8/1988 Egan .
4,798,298 1/1989 Ursetta .
4,988,007 1/1991 Chiarot ..... 211/70.5
5,183,164 2/1993 Heinzle .

*Primary Examiner*—Robert W. Gibson, Jr.
*Attorney, Agent, or Firm*—Coudert Brothers

[57] ABSTRACT

A holder apparatus and Method for suspending a pair of skis in a bottom to bottom orientation, each ski having a body portion, a tail portion and an outward arching ski tip portion. The holder apparatus comprises a mounting plate, a pair of pivot members mounted on the mounting plate, and a pair of mounting members pivotally mounted on the pivot members adapted to receive the pair of skis therebetween. The mounting members each comprise an upper portion to support a respective one of the ski tip portions and a lower portion to support a respective one of the body portions. The pivot members are spaced apart horizontally by an amount which is sufficient to suspend the pair of skis and hold the pair of ski tail portions together.

9 Claims, 3 Drawing Sheets

APPARATUS AND METHODS FOR SUSPENDING A PAIR OF SKIS OR THE LIKE

FIELD OF THE INVENTION

The present invention relates generally to apparatus and methods for suspending a pair of skis or the like. More particularly, the present invention is directed to apparatus and methods for statically suspending a pair of skis which are oriented in a bottom-to-bottom relationship.

BACKGROUND OF THE INVENTION

In recent years, several possibilities have become known for supporting skis by an apparatus mounted on a wall or a frame.

U.S. Pat. No. 4,763,797 to Egan discloses a ski rack utilizing pairs of pivotally mounted blocks on a rail to capture a ski. The design takes advantage of the widening of the ski towards its tip to wedge the ski downward against the blocks. Each unit, however, holds only one ski and the blocks must be individually adjusted for each different ski. Once an adjustment is made, only one size ski may be used in the slot.

U.S. Pat. No. 4,798,298 to Ursetta discloses a holder for skis wherein a support plate holds two rotatable rollers arranged next to each other. The axis of rotation of each roller is eccentric to the center axis of the roller. A circular arc-shaped recess is cut into each roller. Compression springs are placed in each recess. The compression springs have the purpose to rotate the two rollers relative to each other. The rollers, which are covered with rubber linings, cooperate to clamp the skis therebetween. Unfortunately, however, the Ursetta device suffers from a number of drawbacks. The device is of very complicated construction and is not very practical. Further, the rollers are pressed on as a result of the force applied by the above-described springs. If the skis are to be placed in the holder, the two rollers must be rotated to such an extent that a sufficiently wide gap is created between the rollers so that the skis can be placed between the rollers. Moreover, since each of the two rollers is supported and spring-loaded individually, two hands are necessarily required for rotating the rollers themselves. Therefore, another person is needed in order to place the skis in the open gap between the rollers.

U.S. Pat. No. 5,183,164 to Heinzle describes a somewhat similar device which has two clamping jaws arranged next to each other. These jaws are eccentrically pivoted to close tighter as the skis are lowered between the jaws. The two jaws are interconnected by a linkage which keeps them rotating symmetrically so as to assure that the pinching forces directly oppose each other. The Heinzle mechanism depends on a high-friction material covering the jaws to keep the smooth skis from slipping between them. This requires laminating two dissimilar materials together, which, as Heinzle discloses, can be a significant problem.

In general, known apparatus and methods suffer from a number of structural and functional disadvantages. It is accordingly a general object of the present invention to provide apparatus and methods for statically suspending a pair of skis or the like which overcome the disadvantages of heretofore known devices and methods. More particularly, it is an object of the present invention to provide a device mounted on a wall or rack or similar support surface for statically suspending a pair of skis oriented in a bottom-to-bottom relationship which is very effective, yet simple to produce and manipulate, and a method for supporting or suspending a pair of skis which is simple to accomplish.

It is a further object of the present invention to provide apparatus and methods for suspending a pair of skis or the like when the skis are positioned in a bottom-to-bottom relationship which eliminates the need for providing means proximate the tails of the skis to prevent the tails from spreading.

It is a further object of the present invention to provide apparatus and methods for statically suspending a pair of skis or the like by the outward arching tips of the skis when the skis are positioned in a bottom-to-bottom relationship.

It is a further object of the present invention to provide apparatus and methods for suspending a pair of skis or the like which is able to accommodate a wide variety of ski shapes and sizes, is adaptable to a wide variety of mounting locations, and is safe to both the user and the equipment being suspended.

SUMMARY OF THE INVENTION

Objects and advantages of the present invention will be set forth in part in the description which follows and in part will be obvious from the description and/or figures, or may be learned by practice of the invention. Such objects and advantages may be realized and attained by the means of the instrumentalities and combinations particularly pointed out in the appended claims.

The present invention overcomes the problems and disadvantages of known apparatus and methods for supporting skis by providing apparatus and methods for suspending a pair of skis which attains the objects described hereinabove.

To achieve the objects in accordance with the present invention, as embodied and broadly described herein, there is provided a holder apparatus for suspending a pair of skis in a bottom-to-bottom orientation, each ski having a body portion, a tail portion and an outward arching ski tip portion. The holder apparatus comprises a mounting plate, a pair of pivot members mounted on the mounting plate, and a pair of mounting members pivotally mounted on the pivot members adapted to receive the pair of skis therebetween. The mounting members each comprise an upper portion to support a respective one of the ski tip portions and a lower portion to support a respective one of the body portions. The pivot members are spaced apart horizontally by an amount which is sufficient to suspend the pair of skis and hold the ski tail portions together.

DETAILED DESCRIPTION OF THE DRAWINGS

Figure 1:
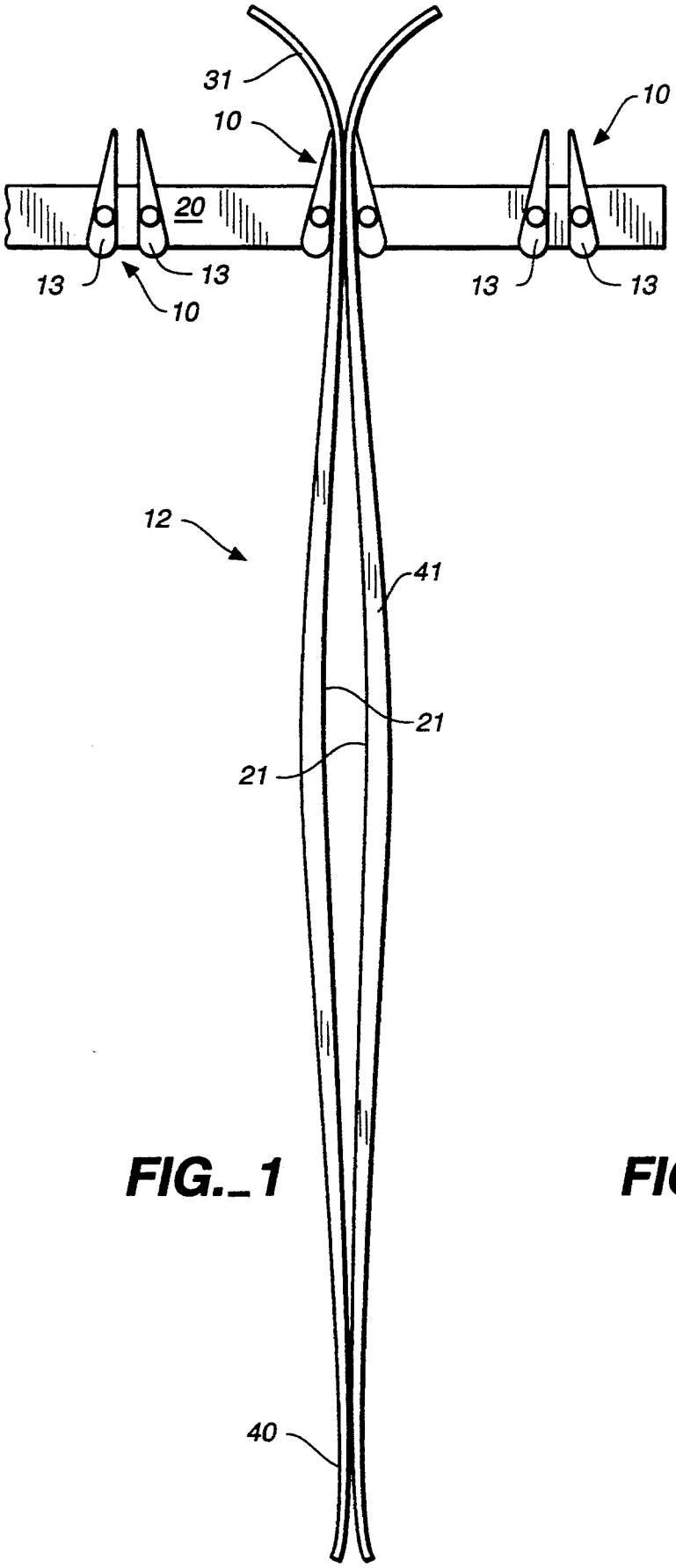
FIG. 1 shows an arrangement of several holders according to the present invention mounted on a wall or a support frame or the like as well as a pair of skis oriented in a bottom-to-bottom relationship suspended in one of the holders.
Figure 2:
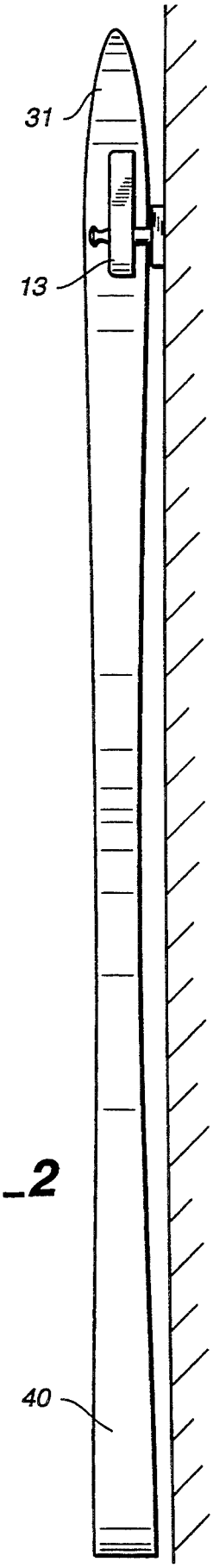
FIG. 2 shows a side view of a holder according to the present invention.

Referring now to the various drawings, wherein like elements are consistently referred to by corresponding reference numerals, there is shown an apparatus 10 which embodies the present invention. Apparatus 10 includes two mounting members or lever arms 13. Lever arms 13 are rotatably fastened to a wall or other suitable mounting means, such as mounting plate 20, by means of pivot members or shafts 24 affixed to mounting plate 20 at axes 16. Shafts 24 are mounted symmetrically relative to each other with respect to a center line 14. Lever arms 13 are mounted so as to be rotatable about axes 16. Lever arms 13 rotate independent of each other, thereby providing a simple mechanism that interacts with a pair of skis 20, which are placed in a bottom-to-bottom orientation as can be clearly seen in FIG. 1, to statically suspend the skis under the force of gravity.

Figure 3:
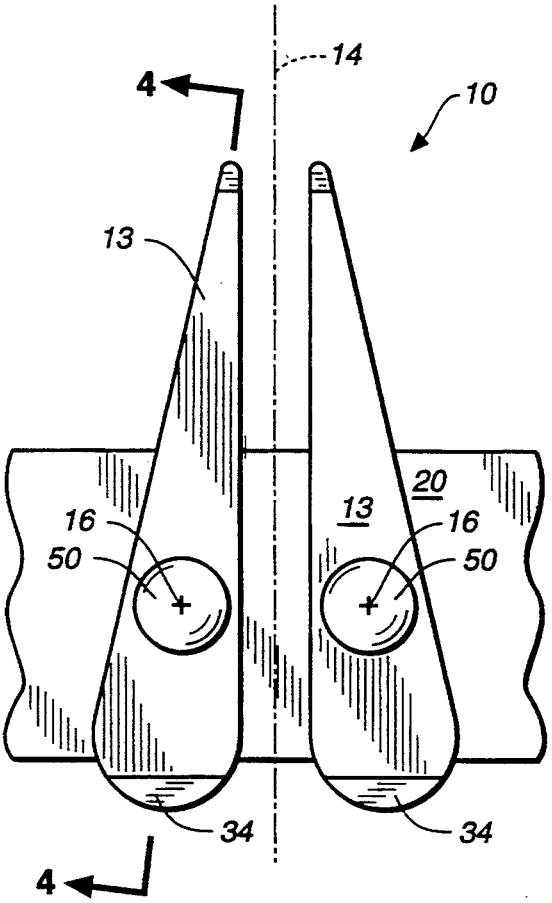
FIG. 3 shows a front view of a holder according to the present invention.
Figure 4:
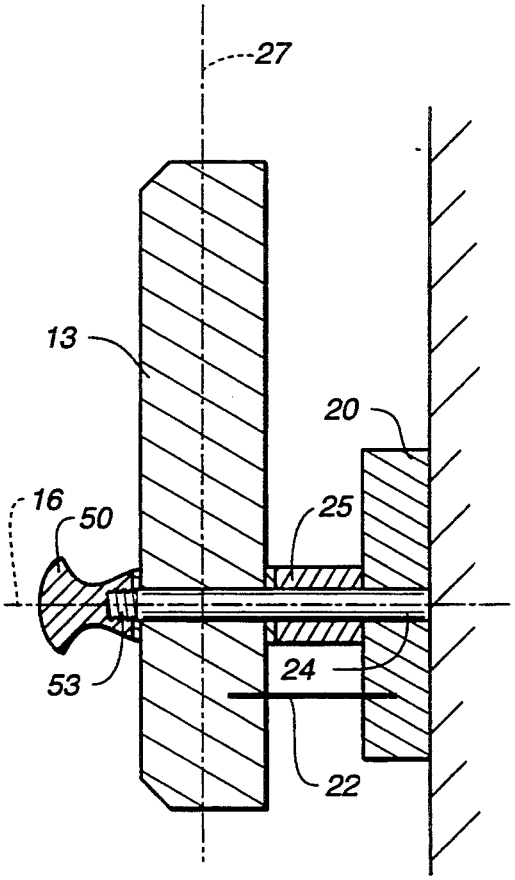
FIG. 4 shows a cross-sectional side view of a holder according to the present invention.

Spacers 25 are employed to hold lever arms 13 a predetermined distance from plate 20 to allow lever arms 13 free rotation and to accommodate skis of varying widths. Those skilled in the art will recognize that it is desirable to space lever arms 13 from plate 20 so that the center line of a variety of skis or the like can coincide with center line 27 of arms 13. Suitable positioning means, such as springs 22, are provided to hold lever arms 13 in approximately a vertical position, or simply apart, to facilitate ease of operation and correspondingly permit rotational movement of arms 13. The positioning means may alternatively comprise counter weights 34 integral with lever arms 13 as shown in FIG. 3. Those skilled in the art will also recognize that the shape and/or weighting of lever arms 13 may be selected so as to achieve the same positioning function.

Lever arms 13 are secured about shafts 24 by suitable means such as threaded knobs 50 at threads 53. Shaft 24 may be permanently secured to plate 20 and knob 50 by means of glue or the like if desired. In the preferred embodiment, elements 13, 20, 24, 25 and 50 are fabricated out of wood to facilitate construction and manufacture and to provide an apparatus which is safe to both the user and the equipment being used. Those skilled in the art will recognize that a wide variety of plastics or the like may be used as alternative materials.

As is illustrated in the various drawings, the apparatus of the present invention comprises lever arms 13 between which a pair of skis 20 are statically suspended by their tip portions 31 which arc outward of the skis 20. In order to statically support skis 20, the skis are first oriented in a bottom-to-bottom relationship so that bottoms 21 face one another. Next, skis 20 are lowered into position so that upper portions 33 of lever arms 13 are forced apart by ski tips 31, thereby squeezing bottom portions 35 of lever arms 13 together. Provided that the relations described hereinbelow are satisfied, tails 40 of skis 20 will be held together, thus dispensing with the need for separate means located proximate the ski tails 40 to hold the tails 40 together.

Figure 5:
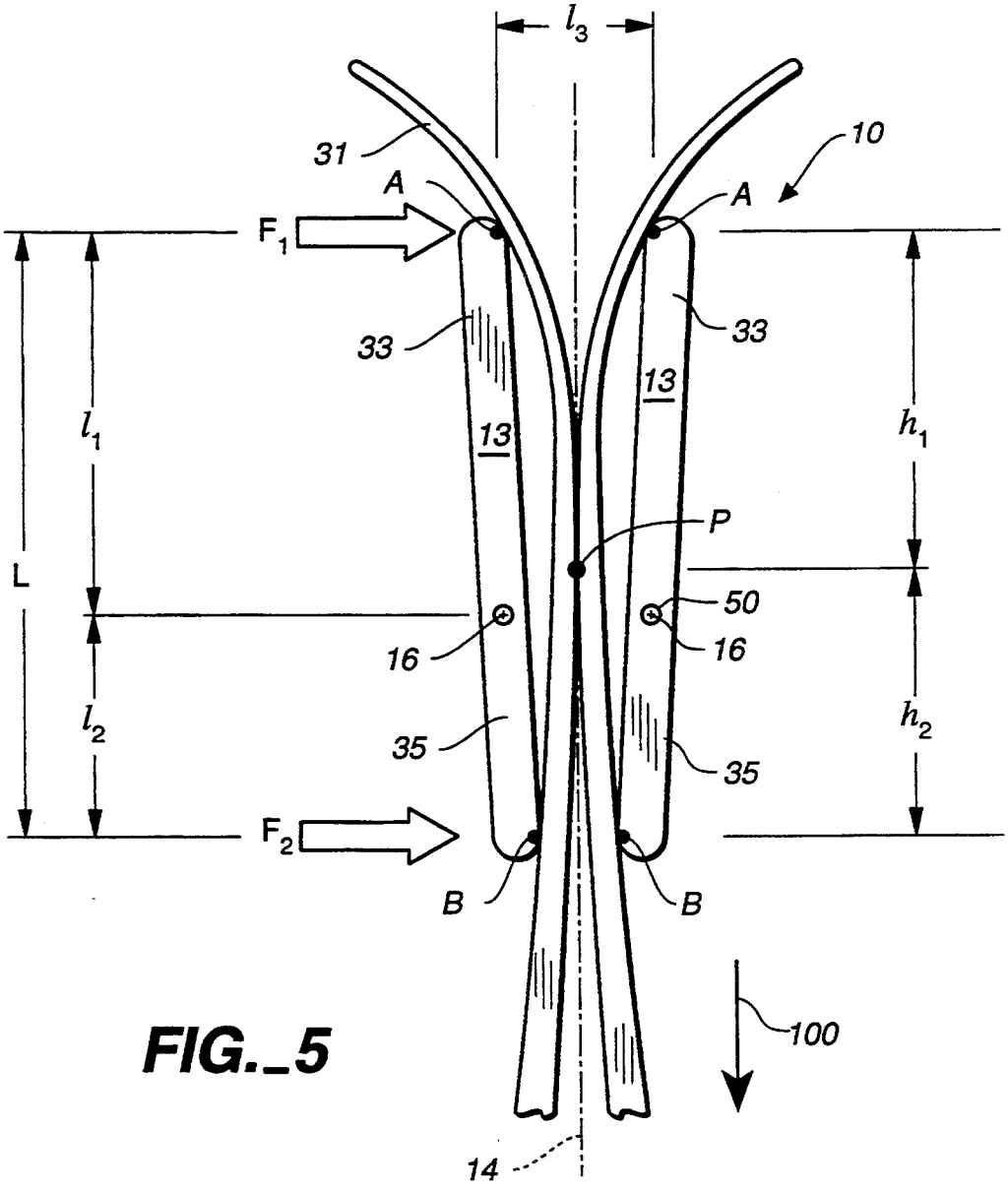
FIG. 5 is a static force-moment diagram of a holder according to the present invention and a pair of bottom-to-bottom oriented skis suspended therein.

The simplicity of the apparatus and methods of the present invention are particularly illustrated in the force-moment diagram of FIG. 5. As illustrated in FIG. 5, skis 20 contact each other at a pinch point P. Those skilled in the art will recognize that tails 40 of skis 20 will be prevented from separating by arms 13 if arms 13 are sized and positioned so that axes 16 are positioned at or preferably below pinch point P. Stated alternatively, pinch point P must be positioned at or above axes 16. Static equilibrium is maintained when the angular acceleration about point P is equal to zero.

In FIG. 5, force $F_1$ is shown acting about a first respective axis 16 perpendicular to a moment arm having a length $l_1$ at contact point A wherein upper portions 33 of arms 13 contact ski tip portions 31 of skis 20. Force $F_2$ is shown acting about axis 16 perpendicular to a moment arm having a length $l_2$ at contact point B wherein lower or bottom portions 35 of arms 13 contact body portions 41 of skis 20. Force $F_1$ is also shown acting about point P perpendicular to a moment arm of length $h_1$ at point A. Similarly, force $F_2$ is also shown acting about point P perpendicular to moment arm of length $h_2$ at point B. The necessary relationships are described mathematically as follows:

$$h_1+h_2=L \tag{1}$$

$$l_1+l_2=L \tag{2}$$

$$F_1l_1=F_2l_2 \tag{3}$$

Equation 3 defines the requirements necessary to maintain static equilibrium. Accordingly, ski tails 40 will be held together if Equation (4) below is satisfied:

$$F_1h_1<F_2h_2 \tag{4}$$

Which is solved as follows:

$$\frac{l_2}{l_1}F_2h_1 < F_2h_2 \tag{5}$$

$$\frac{l_2}{l_1} < \frac{h_2}{h_1} \tag{6}$$

$$\frac{L-l_1}{l_1} < \frac{L-h_1}{h_1} \tag{7}$$

$$\frac{L}{l_1} - 1 < \frac{L}{h_1} - 1 \tag{8}$$

$$\frac{L}{l_1} < \frac{L}{h_1} \tag{9}$$

$$l_1 > h_1 \tag{10}$$

As demonstrated above, the relationship $l_1>h_1$ ensures that skis 20 will be held in suspension and that ski tails 40 will be held together. Those skilled in the art will recognize that the above described relationship is satisfied by properly selecting the length of portions 33 and 35 of members 13 and length $l_3$, the distance between axes 16. Any number of appropriate selections can be made using well known mathematical methods.

The foregoing relates to preferred exemplary embodiments of the invention, it being understood that other variants and embodiments thereof are possible within the spirit and scope of the invention, the latter being defined by the appended claims.

I claim:

1. A holder apparatus for suspending a pair of skis in a bottom-to-bottom orientation, each ski having a body portion, a tail portion and an outward arcing ski tip portion, the holder apparatus comprising;

a mounting plate;

a pair of pivot members mounted on said mounting plate; and a pair of mounting members pivotally mounted on said pivot members adapted to receive the pair of skis therebetween, said mounting members each comprising an upper portion to support a respective one of the ski tip portions and a lower portion to support a respective one of the body portions, said pivot members being spaced apart by an amount sufficient to suspend the pair of skis and hold the ski tail portions together.

2. A holder apparatus according to claim 1, wherein each of said mounting members comprises an upper elongated portion and a lower elongated portion, the length of said upper and lower elongated portions being selected so that the ski tail portions are held together.

3. A holder apparatus for suspending a pair of skis in a bottom-to-bottom orientation, each ski having a body portion, a tail portion and an outward arcing ski tip portion, the holder apparatus comprising;

a mounting plate;

a pair of pivot members mounted a first distance from each other on said mounting plate; and a pair of mounting members pivotally mounted on said pivot members adapted to receive the pair of skis therebetween, said mounting members each comprising an upper portion to bias a respective one of the ski tip portions and a lower portion to bias a respective one of the body portions, wherein the length of each of the mounting members and said first distance are selected so that the pair of skis are suspended between said pivot members and so that the ski tail portions are held together.

4. A holder apparatus according to claim 3, the pair of skis forming a pinch point, wherein the length of each of the mounting members and the length of said first distance are selected so that the pair of skis are suspended between said pivot members and so that the pinch point is located vertically at or above a line drawn between said pair of pivot members.

5. A holder apparatus for suspending a pair of skis in a bottom-to-bottom orientation, the pair of skis forming a pinch point, said holder apparatus comprising:

a mounting plate;

a pair of pivot members mounted on said mounting plate; and a pair of elongated mounting members pivotally mounted on said pivot members adapted to support the pair of skis hanging therebetween, said mounting members each comprising an upper portion and a lower portion, said upper portions each being urged outward about respective ones of said pivot members so as to cause each of said lower portions to urge the pair of skis together below the pinch point.

6. A holder apparatus according to claim 5, each ski having a body portion, a tail portion and an outward arcing ski tip portion, wherein said upper portions are urged outward by respective ones of the ski tip portions.

7. A holder apparatus according to claim 5, each ski having a body portion, a tail portion and an outward arcing ski tip portion, the length of said upper and lower portions being selected so that the tail portions are held together.

8. A holder apparatus according to claim 7, said pivot members being spaced apart by an amount sufficient to suspend the pair of skis and hold the ski tail portions together.

9. A method for supporting a pair of skis from a pair of mounting members, each ski having a body portion, a tail portion and an outward arcing ski tip portion, which prevents the tail portions of the pair of skis from separating, the mounting members being pivotally mounted on a pair of pivot members adapted to support the pair of skis hanging therebetween, said method comprising the steps of:

orienting the pair of skis in a bottom-to-bottom relationship so that a pinch point is formed;

placing the skis between the two pivot members so that an upper portion of each mounting member contacts a respective one of the ski tip portions of the pair of skis and a lower portion of each mounting member contacts a respective one of the body portions of the pair of skis.

* * * * *